US010775095B2

(12) United States Patent
Gwon et al.

(10) Patent No.: US 10,775,095 B2
(45) Date of Patent: Sep. 15, 2020

(54) REFRIGERATOR

(71) Applicant: LG Electronics Inc., Seoul (KR)

(72) Inventors: Seongwon Gwon, Seoul (KR); Hyunbum Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 16/069,321

(22) PCT Filed: Jan. 13, 2017

(86) PCT No.: PCT/KR2017/000476
§ 371 (c)(1),
(2) Date: Jul. 11, 2018

(87) PCT Pub. No.: WO2017/123050
PCT Pub. Date: Jul. 20, 2017

(65) Prior Publication Data

US 2019/0024964 A1 Jan. 24, 2019

(30) Foreign Application Priority Data

Jan. 14, 2016 (KR) ..... 10-2016-0004831

(51) Int. Cl.
*F25D 23/00* (2006.01)
*F25D 23/02* (2006.01)
(Continued)

(52) U.S. Cl.
CPC ..... *F25D 23/025* (2013.01); *E06B 7/20* (2013.01); *F25D 23/02* (2013.01); *F25D 23/028* (2013.01);
(Continued)

(58) Field of Classification Search
CPC ..... F25D 23/04; F25D 23/94; F25D 23/028; F25D 23/065; F25D 23/02; F25D 23/007;
(Continued)

(56) References Cited

U.S. PATENT DOCUMENTS 5,411,328 A * 5/1995 You ..... F25D 23/028 312/405
9,188,382 B2 * 11/2015 Kim ..... F25D 21/04
(Continued)

FOREIGN PATENT DOCUMENTS

EP 2610566 * 7/2013
EP 2639534 * 9/2013
(Continued)

OTHER PUBLICATIONS

KR 2005099573; Lee; figure and abstract (Year: 2005).*

*Primary Examiner* — Janet M Wilkens
(74) *Attorney, Agent, or Firm* — Fish & Richardson P.C.

(57) ABSTRACT

A refrigerator includes a cabinet having a storage chamber, an inner case that defines the storage chamber, a first door rotatably installed on the cabinet and configured to open and close one side of the storage chamber, a second door that includes a pillar configured to rotate and contact the first door and that is installed on the cabinet and configured to open and close another side of the storage chamber, and a transfer member provided inside the inner case and configured to sense rotation of the second door and to guide rotation of the pillar. The transfer member includes a lifting guide portion that is configured to, based on the pillar approaching the lifting guide portion, move downward and contact the pillar while the pillar remains unfolded.

18 Claims, 10 Drawing Sheets

(51) Int. Cl.
*F25D 25/02* (2006.01)
*E06B 7/20* (2006.01)

(52) U.S. Cl.
CPC ..... *F25D 25/025* (2013.01); *F25D 2323/02* (2013.01); *F25D 2323/021* (2013.01)

(58) Field of Classification Search
CPC .... F25D 2323/021; F25D 25/02; F25D 11/02; F25D 11/00; F16H 19/04; E06B 7/20; E05C 5/00; E05C 7/04
USPC ..... 312/404, 405
See application file for complete search history.

(56) References Cited

U.S. PATENT DOCUMENTS 9,874,391 B2 * 1/2018 Jung ..... E05C 5/00
10,393,424 B2 * 8/2019 Lee ..... F25D 23/066
2010/0071404 A1 * 3/2010 Han ..... F25D 23/02 62/441
2017/0254583 A1 * 9/2017 Kim ..... F25D 23/028
2018/0010845 A1 * 1/2018 Kim ..... F25D 23/02

FOREIGN PATENT DOCUMENTS

EP 2741034 * 6/2014
JP 2013-108706 6/2013
KR 10-2010-0035095 4/2010
KR 20110032898 * 3/2011
KR 10-2013-0026325 3/2013
KR 10-2014-0046207 4/2014
KR 10-2014-0147970 12/2014
WO 2007115868 * 10/2007
WO 2014204238 * 12/2014
WO 2017126846 * 7/2017

* cited by examiner

【fig 1】
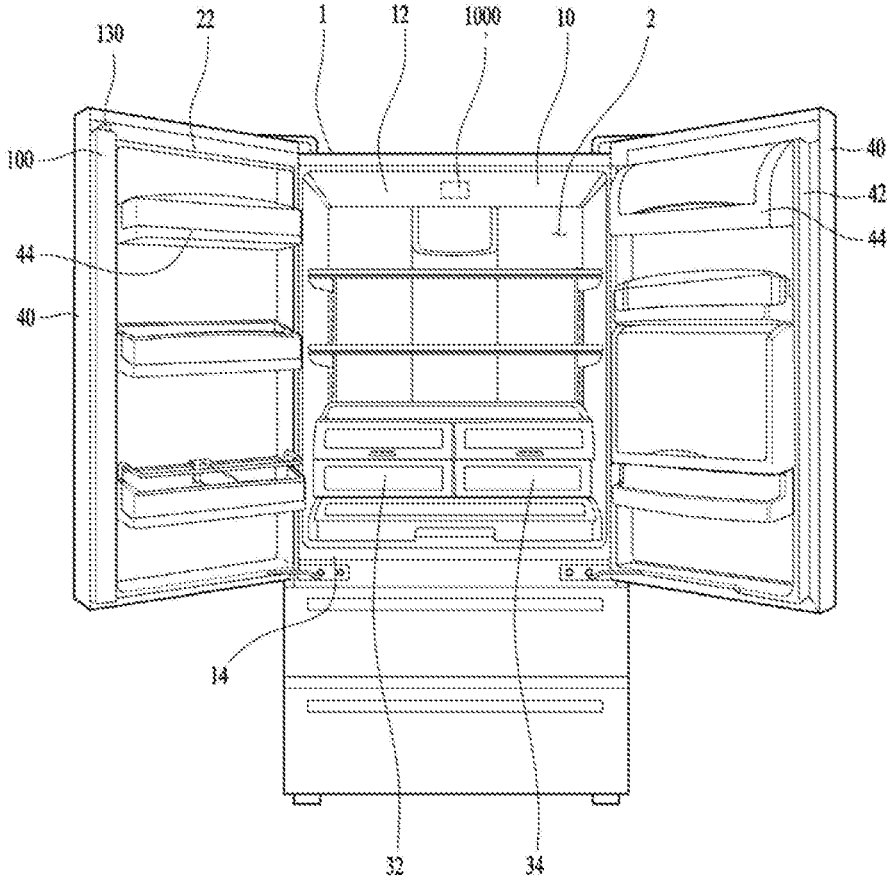

【fig 2】
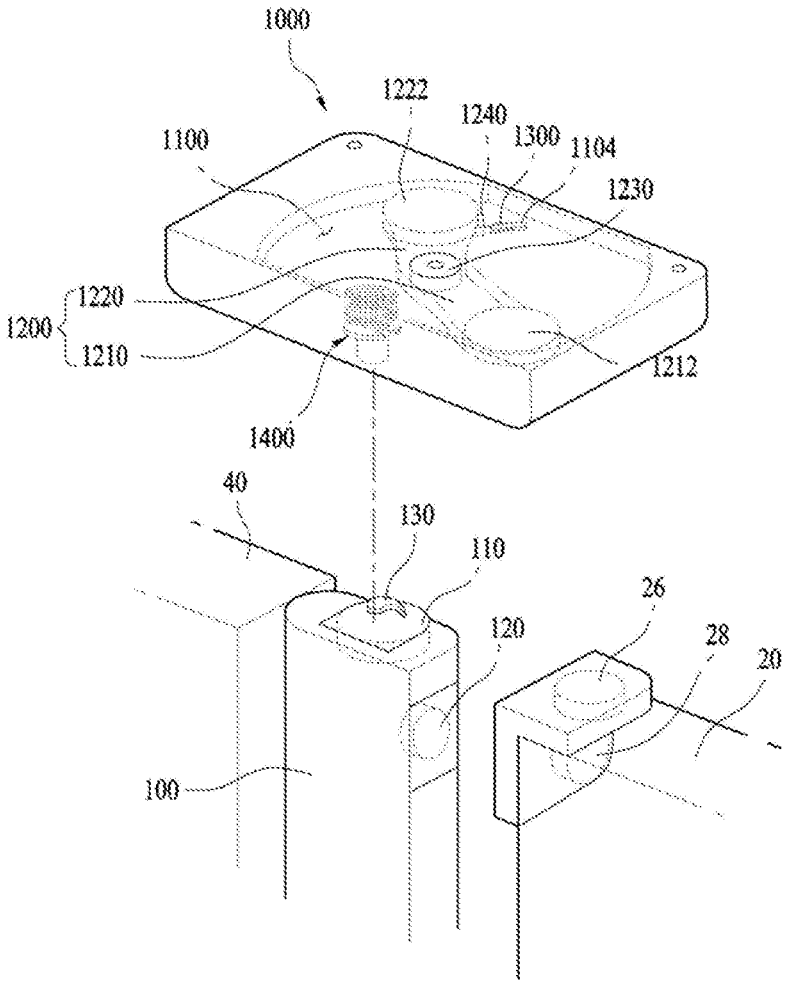

【fig 3】
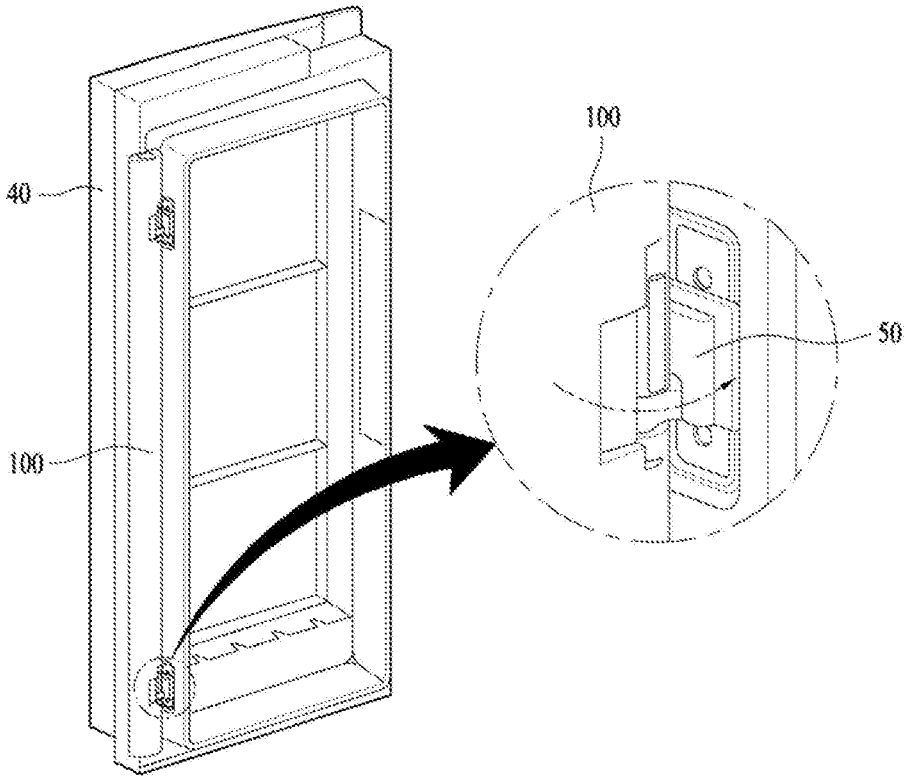

【fig 8】
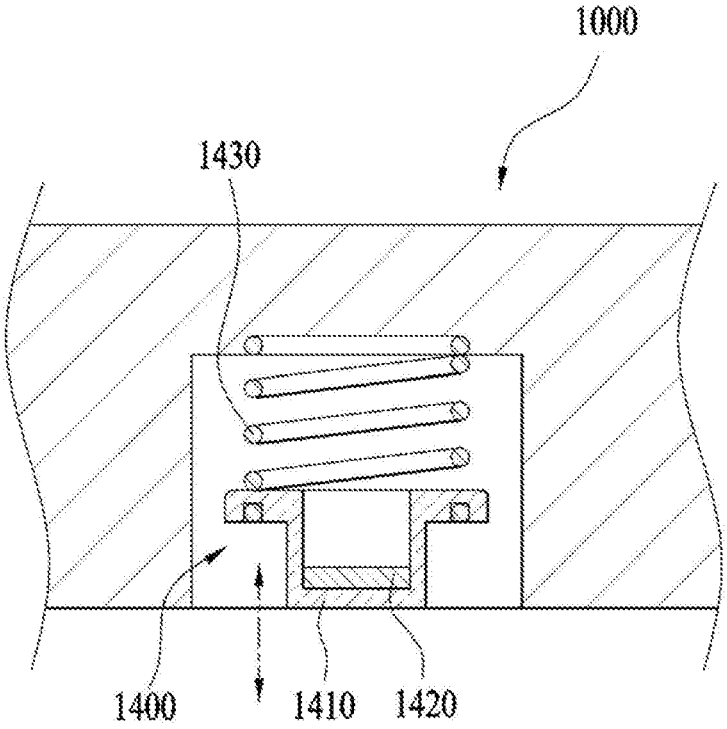

REFRIGERATOR

CROSS-REFERENCE TO RELATED APPLICATIONS

This application is a National Stage application under 35 U.S.C. § 371 of International Application No. PCT/KR2017/000476, filed Jan. 13, 2017, which claims the benefit of Korean Application No. 10-2016-0004831, filed on Jan. 14, 2016. The disclosures of the prior applications are incorporated by reference in their entirety.

TECHNICAL FIELD

The present invention relates to a refrigerator and, more particularly, to a refrigerator having improved convenience of use, the refrigerator being of a type in which two doors arranged side by side are used to open a single storage compartment.

BACKGROUND ART

In general, a refrigerator is an apparatus that may keep food fresh for a certain duration by cooling a storage compartment (a freezing compartment or a refrigerating compartment) while repeating a freezing cycle.

The refrigerator includes a compressor, which compresses refrigerant, circulating through a freezing cycle, into high-temperature and high-pressure refrigerant. The refrigerant, compressed in the compressor, cools air while passing through a heat exchanger, and the cooled air is supplied to the freezing compartment or the refrigerating compartment.

The refrigerator may have a configuration in which the freezing compartment is at the upper side and the refrigerating compartment is at the lower side. A side-by-side-type refrigerator may be configured such that the freezing compartment and the refrigerating compartment are arranged side by side on the left and right sides, respectively.

In addition, there is another type of refrigerator in which a single storage compartment, provided at the upper side or the lower side, may be opened by two doors, which are arranged side by side.

In the case where two doors are arranged side by side to open or close a single storage compartment, a pillar is installed on one of the two doors. The pillar is provided at any one of the two doors, and functions to increase the sealing efficiency of the storage compartment by coming into contact with the two doors when the two doors seal the storage compartment.

In the related art, in order to rotate the pillar, an inner case of the refrigerator is generally provided with a structure including a protrusion and a guide groove to guide the rotation of the pillar.

According to the related art, the structure for guiding the rotation of the pillar needs to protrude downwards from the upper side of the inner case, and thus a user experiences inconvenience when using the storage compartment.

In addition, in the state in which the door provided with the pillar seals the storage compartment, the pillar may block the path along which a drawer installed in the refrigerator moves because the pillar is moved away and unfolded from the corresponding door. Therefore, in the case where two drawers are arranged parallel to each other, the two drawers must have different widths.

In addition, in consideration of the fact that the pillar is in the unfolded state, in the case where a basket is installed in the door so as to be rotated together with the door, the basket requires a gently curved corner portion so as not to come into contact with the pillar, which may result in a reduction in the storage capacity of the basket.

DISCLOSURE

Technical Problem

An object of the present invention devised to solve the problem is to provide a refrigerator having improved convenience of use, the refrigerator being of a type in which two doors arranged side by side are used to open a single storage compartment.

Technical Solution

The present invention provides a refrigerator including a cabinet including a storage compartment, an inner case defining the external appearance of the storage compartment, a first door rotatably installed to the cabinet to open or close a portion of the storage compartment, a second door including a pillar configured to be rotated so as to come into contact with the first door, the second door being rotatably installed to the cabinet to open or close the remaining portion of the storage compartment, and a transmission unit provided in the inner case, the transmission unit being configured to sense rotation of the second door to guide rotation of the pillar, wherein the pillar is disposed so as to be spaced apart from the top wall of the inner case and the bottom wall of the inner case in order to prevent contact with the inner case in the state in which the second door seals the storage compartment, and the transmission unit includes a lifting guide unit that is lowered when the pillar approaches the lifting guide unit and that comes into contact with the pillar in the state in which the pillar is unfolded.

The pillar may include a pillar protrusion that protrudes from the upper side thereof to an extent that prevents contact with the ceiling of the inner case, and the pillar protrusion may guide the folding of the pillar through contact with the lifting guide unit.

The pillar protrusion may be formed so as to be located on the rear side of the lifting guide unit when the lifting guide unit is lowered.

The pillar may be provided at an upper side thereof with a first pillar magnetic member, and the lifting guide unit may be provided with a steel plate member that magnetically interferes with the first pillar magnetic member.

The lifting guide unit may include a case enveloping the steel plate member and an elastic member elastically supporting the case in an upward direction.

When the pillar approaches the lifting guide unit, the elastic member may be extended, and the case may be lowered.

The transmission unit may include a rotary arm that is rotated based on whether the first door is rotated.

The rotary arm may be provided at one end thereof with a first magnetic member, and may be provided at the opposite end thereof with a second magnetic member.

The rotary arm may have a rotation center located between the first magnetic member and the second magnetic member.

The first door may be provided at an upper side thereof with a first door magnetic member that magnetically interferes with the first magnetic member, and may be provided on a lateral surface thereof with a second door magnetic member, and the pillar may be provided on a lateral surface thereof with a second pillar magnetic member that magnetically interferes with the second door magnetic member.

The pillar may be disposed so as to be rotatable in the state in which the first door opens the storage compartment and the second door seals the storage compartment.

When the first door and the second door seal the storage compartment, the pillar may come into contact with the first door and the second door.

The refrigerator may further include a first drawer disposed near the first door and a second drawer disposed near the second door, and the first drawer and the second drawer may have the same width.

The first drawer and the second drawer may be disposed in the same horizontal plane, and may be pulled outwards independently of each other.

The first door and the second door may have the same width.

Advantageous Effects

According to the present invention, a structure for rotating a pillar does not protrude toward a storage compartment, which may result in an increase in the capacity of the storage compartment and may resolve inconvenience caused to a user due to the protruding configuration.

In addition, in the state in which only a door having a pillar seals a storage compartment and an opposite door opens the storage compartment, the pillar is in the folded state, and therefore does not interfere with a drawer installed near the opposite door when the drawer is pulled outwards. This may allow a pair of drawers having the same width to be installed at both sides.

In addition, in the state in which only the door having the pillar seals the storage compartment and the opposite door opens the storage compartment, the pillar is in the folded state, and therefore does not interfere with a basket installed in the opposite door when the opposite door is rotated. This may allow the basket to have a sharp corner, thus increasing the storage capacity of the basket.

In addition, when two doors are opened at the same time, the pillar may be folded.

DESCRIPTION OF DRAWINGS

FIG. 1 is a front view of a refrigerator according to an embodiment of the present invention.

FIG. 2 is a view illustrating major parts according to the embodiment.

FIG. 3 is a view for explaining a pillar-fixing unit according to the embodiment.

FIG. 8 is a cross-sectional view illustrating the operation of a lifting guide unit.

BEST MODE

Figure 4A:
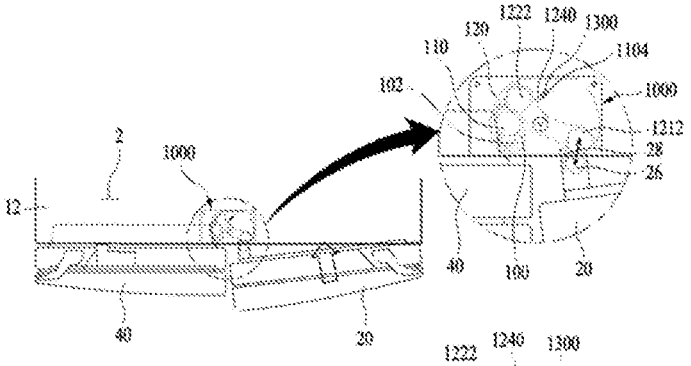
FIGS. 4A to 4C are views for explaining the state in which a first door is being closed when a second door is in the closed state.

Hereinafter, exemplary embodiments of the present invention will be described with reference to the accompanying drawings in order to concretely realize the object as set forth above.

In the drawings, the sizes or shapes of elements may be exaggerated for clarity and convenience of description. Furthermore, terms particularly defined in consideration of construction and operation of the present invention can be changed according to the custom or intention of users or operators. Therefore, definition of the terms should be made according to the overall disclosures set forth herein.

FIG. 1 is a front view of a refrigerator according to an embodiment of the present invention.

Referring to FIG. 1, the refrigerator according to the embodiment includes a cabinet 1, which defines the external appearance of the refrigerator.

The cabinet 1 has a storage compartment 2 in which food may be stored.

The external appearance of the storage compartment 2 may be defined by an inner case 10, which is provided inside the cabinet 1. The inner case 10 may include a top wall 12 and a bottom wall 14, which form the inner surface of the storage compartment 2, and the front side of the storage compartment 2 may be open in order to allow a user to access the storage compartment 2 through the front side of the storage compartment 2. The top wall 12 defines a ceiling 12 of the storage compartment 2 or the inner case 10.

The cabinet 1 is provided at the front side thereof with a first door 20, which is rotatably installed to the cabinet 1 so as to open or close a portion of the storage compartment 2, and a second door 40, which is rotatably installed to the cabinet 1 so as to open or close the remaining portion of the storage compartment 2. At this time, when the first door 20 and the second door 40 close the front side of the storage compartment 2, the entire storage compartment 2 may be sealed.

A pillar 100 may be rotatably installed on the second door 40 so as to come into contact with the first door 20. The pillar 100 may generally have a rectangular parallelepiped shape, and may be coupled to the second door 40 so as to be rotated relative to the second door 40. At this time, the pillar 100 may be positioned such that the rotated angle thereof relative to the second door 40 varies based on, for example, the angle by which the second door 40 is rotated relative to the storage compartment 2, or based on whether the first door 20 opens or closes the storage compartment 2.

The pillar 100 has a length that is shorter than the distance between the top wall 12 and the bottom wall 14 of the inner case 10 so as not to come into contact with the top wall 12 and the bottom wall 14. That is, even when the second door 40 is rotated and seals the storage compartment 2, the pillar 100 does not come into contact with either the top wall 12 or the bottom wall 14. Any element that may restrict the rotation of the pillar 100 is not located at the top wall 12 or the bottom wall 14, and thus the inner case 10 may have a structural shape in which each of the top wall 12 and the bottom wall 14 is generally formed in a single planar shape.

The pillar 100 is provided at the upper side thereof with a pillar protrusion 130. The pillar protrusion 100 protrudes to an extent that prevents contact with the top wall 12, i.e. the ceiling 12.

The first door 20 may include a door dike 22, which defines the rear appearance of the first door 20. In addition, the second door 40 may include a door dike 42, which defines the rear appearance of the second door 40.

Baskets 44 and 24 may respectively be installed to the door dikes 42 and 22, and may be used to store various shapes of food therein. At this time, the basket 24, which is installed to the first door 20, which is not provided with the pillar 100, does not interfere with the pillar 100 when the first door 20 is rotated. Therefore, the basket 24 may have a sharp corner. Accordingly, the basket 24 may store an increased amount of food compared to a basket having a rounded corner.

The storage compartment 2 may be provided with a first drawer 34, located near the first door 20, and a second drawer 32, located near the second door 40. At this time, the first drawer 34 and the second drawer 32 may be disposed in the same horizontal plane. That is, the first drawer 34 and the second drawer 32 may be arranged on the left and right sides, respectively, at the same height within the storage compartment 2. The first drawer 34 and the second drawer 32 may be pulled outwards independently of each other.

The first drawer 34 and the second drawer 32 may have the same width. That is, the first drawer 34 and the second drawer 32 may have the same storage capacity, and may be replaced with each other. Assuming that the first drawer 34 and the second drawer 32 have different widths, and thus different shapes, the first drawer 34 and the second drawer 32 need to be manufactured differently, which may inevitably increase manufacturing costs. On the other hand, assuming that the two drawers have the same shape, manufacturing costs thereof may be advantageously reduced.

In the embodiment of the present invention, the function described above may be implemented because, when the first door 20 is opened and the first drawer 34 is pulled outwards in the state in which the second door 40 seals the storage compartment 2, the pillar 100 is not located in the path along which the first drawer 34 is pulled outwards. The reason why the pillar is not located in the path will be described in detail later with reference to other drawings.

Meanwhile, in the embodiment of the present invention, the first door 20 and the second door 40 may have the same width. Thus, the first door 20 and the second door 40 may share some of the production processes thereof, which may reduce the production costs of the doors. The reason for this will be described later with reference to other drawings.

A transmission unit 1000 may be provided inside the top wall 12 of the inner case 10, and may serve to rotate the pillar 100 under a specific condition.

In the embodiment of the present invention, the transmission unit 1000 may be installed inside the top wall 12 so as not to be exposed to a user.

Accordingly, a portion of the top wall 12 in which the transmission unit 1000 is installed and a neighboring portion thereof in which the transmission unit 1000 is not installed may be formed at the same height. That is, the portion in which the transmission unit 1000 is installed and the remaining portion adjacent thereto are formed in the same plane, and thus it is impossible for a user to recognize whether the transmission unit 1000 is installed inside the inner case 10 merely by viewing the inner case 10. Therefore, it may be possible to prevent problems such as inconvenience that may be caused to a user due to the configuration in which the portion in which the transmission unit 1000 is installed protrudes, a reduction in the storage capacity, or the like.

FIG. 2 is a view illustrating major parts according to the embodiment.

Referring to FIG. 2, the embodiment of the present invention may be configured such that the pillar 100 is rotated in a manner such that the transmission unit 1000 senses the position of a magnetic member installed in the first door 20 and exerts an influence on a magnetic member installed in the pillar 100.

The transmission unit 1000, installed inside the top wall 12 of the inner case 10, may sense the rotation of the second door 40, and may guide the rotation of the pillar 100.

The transmission unit 1000 includes a space portion 1100, which defines an empty space therein, a rotary arm 1200, which is rotatably provided in the space portion 1100, and an elastic member 1300, which applies force to the rotary arm 1200 so that the rotary arm 1200 returns to a prescribed position when external force applied to the rotary arm 1200 is eliminated.

The space portion 1100 may provide a path along which the rotary arm 1200 is rotated when an external force is applied to the rotary arm 1200, particularly, when the rotary arm 1200 is influenced by a magnetic force.

Here, the space portion 1100 may be a space formed inside a separately provided housing, or may be a certain space formed inside the top wall 12 of the inner case 10.

The rotary arm 1200 may include a rotation center portion 1230, which is disposed at one side inside the space portion 1100 and about which the rotary arm 1200 rotates. The rotation center portion 1230 may be coupled to the wall surface, which is the outer circumferential surface of the space portion 1100, so as to enable the rotary arm 1200 to rotate thereabout.

The rotary arm 1200 may include a first arm 1210 and a second arm 1220, which extend from the rotation center portion 1230.

The first arm 1210 may be provided at one end thereof with a first magnetic member 1212 having a magnetic force, and the second arm 1220 may be provided at one end thereof with a second magnetic member 1222 having a magnetic force. The first magnetic member 1212 and the second magnetic member 1222 may be disposed opposite each other about the rotation center portion 1230 of the rotary arm 1200 so as to secure sufficient rotational force when the rotary arm 1200 rotates.

Here, the second arm 1220 may have a length that is shorter than the length of the first arm 1210. Even when the magnetic force that is applied to the first magnetic member 1212 is less than the magnetic force that is applied to the second magnetic member 1222, the rotary arm 1200 may be rotated by the first magnetic member 1212. This is because the first arm 1210 generates a relatively large rotational force due to the relatively long length thereof even when the force applied to the first magnetic member 1212 is relatively small.

A fixing member 1104 may be provided in the space portion 1100, and the second arm 1220 may be provided with a fixing protrusion 1240. The fixing protrusion 1240 may be formed on the surface of the second arm 1220 that faces the fixing member 1104. The fixing member 1104 and the fixing protrusion 1240 may be fixed by an elastic member 1300. At this time, the elastic member 1300 may have restoring force by which it is extended when an external force is applied thereto and is restored to the original length thereof when the external force is eliminated.

That is, in the state in which the rotary arm 1200 has been rotated in the counterclockwise direction by the external force applied thereto, the elastic member 1300 may provide the restoring force to the rotary arm 1200 so that the rotary arm 1200 can be rotated in the clockwise direction when the external force is eliminated.

The transmission unit 1000 includes a lifting guide unit 1400, which is lowered when the pillar 100 approaches the lifting guide unit 1400. As shown in FIG. 2, in the state in which the lifting guide unit 1400 has been raised, the bottom surface of the lifting guide unit 1400 may be disposed in the same plane as the bottom surface of the transmission unit 1000, or may be disposed higher than the bottom surface of the transmission unit 1000. Therefore, when the pillar 100 is distant from the transmission unit 1000, a user may not recognize the presence of the lifting-guide unit 1400.

The first door 20 may be provided with a first door magnetic member 26, which magnetically interferes with the first magnetic member 1212. The first door magnetic member 26 and the first magnetic member 1212 may be arranged such that the surfaces thereof from which magnetic force is generated face each other so as to cause greater magnetic interference therebetween.

In addition, the pillar 100 may be provided with a first pillar magnetic member 110, which magnetically interferes with the second magnetic member 1222. The first pillar magnetic member 110 and the second magnetic member 1222 may be arranged such that the surfaces thereof from which magnetic force is generated face each other so as to cause greater magnetic interference therebetween.

Meanwhile, the pillar protrusion 130 may be located above the first pillar magnetic member 110. The pillar protrusion 130 may include an outer side, which is formed in the shape of an arc, and an inner side, which is formed in the shape of an arc that has a smaller radius than the arc of the outer side.

The inner side of the pillar protrusion 130 may be formed so as to surround the rear surface of the lifting guide unit 1400. The pillar protrusion 130 is not disposed on the front surface of the lifting guide unit 1400, but is disposed on the rear surface of the lifting guide unit 1400. Therefore, the lifting guide unit 1400 may not move independently of the pillar protrusion 130, but may be caught by the pillar protrusion 130, thereby restricting the rotation direction of the pillar 100. That is, in the state in which the lifting guide unit 1400 is in contact with the pillar protrusion 130, the pillar 100 is rotated only in the counterclockwise direction on the basis of FIG. 2, and cannot be rotated in the clockwise direction. That is, in the state in which the lifting guide unit 1400 is caught by the pillar protrusion 130, the pillar 100 may be folded.

In addition, when the pillar 100 is rotated so as to be folded by the respective magnetic members, the pillar protrusion 100 is not caught by the lifting guide unit 1400, and thus the pillar 100 may be folded without being restricted by the lifting guide unit 1400.

The first door 20 may be provided on the lateral surface thereof with a second door magnetic member 28, and the pillar 100 may be provided on the lateral surface thereof with a second pillar magnetic member 120. The second door magnetic member 28 may magnetically interfere with the second pillar magnetic member 120. The second pillar magnetic member 120 and the second door magnetic member 28 may be arranged such that the surfaces thereof from which magnetic force is generated face each other so as to cause greater magnetic interference therebetween.

The first magnetic member 1212 and the first door magnetic member 26, the second magnetic member 1222 and the first pillar magnetic member 110, and the second door magnetic member 28 and the second pillar magnetic member 120 may respectively be configured to use repulsive magnetic force. That is, the first magnetic member 1212 and the first door magnetic member 26, the second magnetic member 1222 and the first pillar magnetic member 110, and the second door magnetic member 28 and the second pillar magnetic member 120 may respectively be arranged so as to be influenced by the repulsive magnetic force.

The use of repulsive magnetic force may overcome shortcomings of use of attractive magnetic force, which requires a large force to separate magnets attracted to each other and which is more sensitive to tolerance variation, because when an attractive magnetic force is generated between two magnets, the magnets try to move so that the magnetic centers thereof coincide with each other.

FIG. 3 is a view for explaining a pillar-fixing unit according to the embodiment.

Referring to FIG. 3, the pillar 100 is rotatably provided at the second door 40.

The pillar 100 may be rotatably installed to a pillar-fixing unit 50 provided at the second door 40.

The pillar-fixing unit 50 may apply force to the pillar 100 in both directions (in the direction in which the pillar is folded and in the direction in which the pillar is unfolded). The pillar-fixing unit 50 may be composed of various elements such as a spring, a rotary cam assembly, or the like.

That is, in the state in which the pillar 100 is rotated at a certain angle, the pillar-fixing unit may induce the pillar to be folded, and in the state in which the pillar 100 is rotated at another angle, the pillar-fixing unit may induce the pillar to be unfolded.

Because the pillar-fixing unit 50 applies force in the direction in which the pillar 100 is folded, when the second door 40 is opened in the state in which the pillar 100 is folded, the pillar 100 may be prevented from flapping. Because the pillar-fixing unit 50 continuously applies force so that the pillar 100 remains folded, it may be possible to prevent the occurrence of vibration or noise attributable to undesired movement of the pillar 100.

In addition, because the pillar-fixing unit 50 applies force in the direction in which the pillar 100 is folded, when the first door 20 is opened, the pillar-fixing unit 50 may provide auxiliary force for folding the pillar 100. When the first door 20 is opened in the state in which the second door 40 closes the storage compartment 2, the pillar 100 needs to be changed to the folded state, which will be described later.

In addition, because the pillar-fixing unit 50 also applies force in the direction in which the pillar 100 is unfolded, it may enable the pillar 100 to be unfolded and to come into contact with the first door 20, so that the storage compartment 2 can be substantially sealed.

For convenience of illustration, in FIGS. 4A to 7C, the lifting guide unit 1400 is omitted from the transmission unit 1000. Also, in the following description, a detailed explanation of the operation of the lifting guide unit 1400 will be omitted.

Figure 4B:
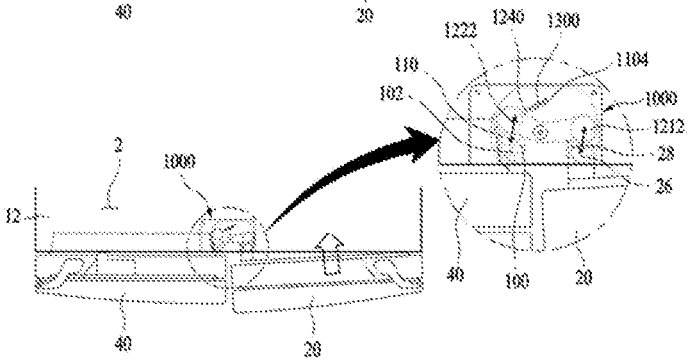
Figure 4C:
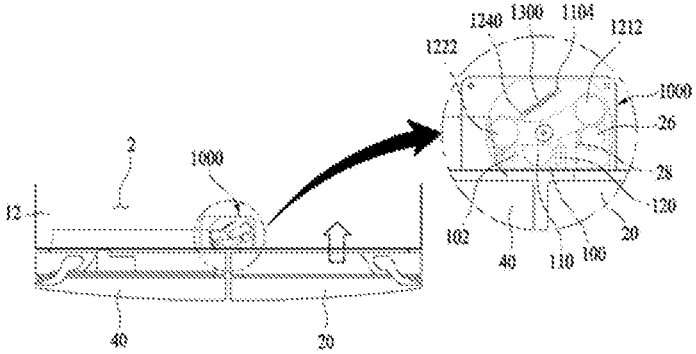

FIGS. 4A to 4C are views for explaining the state in which the first door is being closed when the second door is in the closed state.

Referring to FIGS. 4A to 4C, when the second door 40 is in the closed state and the first door 20 is in the opened state, a user may rotate the first door 20 to close the same.

In the state in which the second door 40 seals the storage compartment 2, when the first door 20 is rotated in order to also seal the storage compartment 2, the pillar 100 needs to be rotated from the folded state to the unfolded state.

As shown in FIG. 4A, when the first door 20 is rotated and approaches the transmission unit 1000, magnetic interference occurs between the first magnetic member 1212 and the first door magnetic member 26. At this time, a repulsive force is generated between the first magnetic member 1212 and the first door magnetic member 26, and thus the rotary arm 1200 is rotated in the counterclockwise direction about the rotation center portion 1230.

As shown in FIG. 4B, as the first door 20 is closed further, the rotary arm 1200 is continuously rotated by the first magnetic member 1212 and the first door magnetic member 26, and magnetic interference occurs between the second magnetic member 1222 and the first pillar magnetic member 110. At this time, a repulsive force is also generated between the second magnetic member 1222 and the first pillar magnetic member 110.

Meanwhile, when the rotary arm 1200 is further rotated in the counterclockwise direction from the state of FIG. 4B, the second magnetic member 1222 is located on the left side of the first pillar magnetic member 110, and the pillar 100 may be unfolded by the repulsive force generated between the second magnetic member 1222 and the first pillar magnetic member 110. Particularly, the second magnetic member 1222 may be located on the left side of a rotation center 102 of the pillar 100. The left side of the rotation center 102 of the pillar 100 is a position at which a repulsive force is provided so that the pillar 100 can be rotated in the clockwise direction about the rotation center 102.

This is because, when the second magnetic member 1222 is located on the left side of the first pillar magnetic member 110, the second magnetic member 1222 applies a repulsive force to the first pillar magnetic member 110, and thus the pillar 100 is rotated away from the second magnetic member 1222, i.e. is rotated in the direction in which the pillar 100 is unfolded.

As shown in FIG. 4C, when the first door 20 seals the storage compartment 2, the first magnetic member 1212 is continuously influenced by the first door magnetic member 26, whereby the rotary arm 1200 is rotated in the counterclockwise direction and the elastic member 1300 is extended.

Due to the repulsive force generated between the first pillar magnetic member 110 and the second magnetic member 1222, the pillar 100 may come into contact with the first door 20 and the second door 40, and may seal the storage compartment 2. At this time, the repulsive force generated between the first pillar magnetic member 110 and the second magnetic member 1222 is greater than the force generated by the pillar-fixing unit 50, and thus it may overcome the force that is applied from the pillar-fixing unit 50 to the pillar 100 in order to fold the pillar 100.

In the state of FIG. 4C, the lifting guide unit 1400 may be lowered, and may be changed to the state of being caught by the pillar protrusion 130. A detailed explanation thereof will be made later with reference to FIGS. 8 to 10C.

Figure 5A:
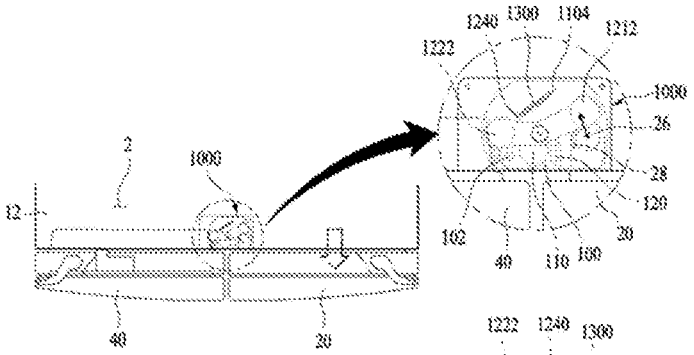
FIGS. 5A to 5C are views for explaining the state in which the first door is being opened when the second door is in the closed state.
Figure 5B:
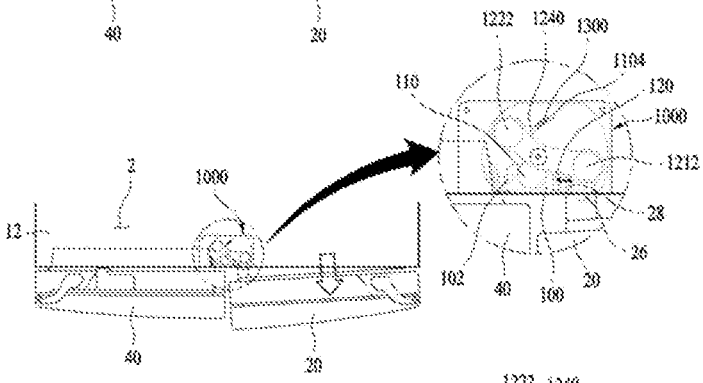
Figure 5C:
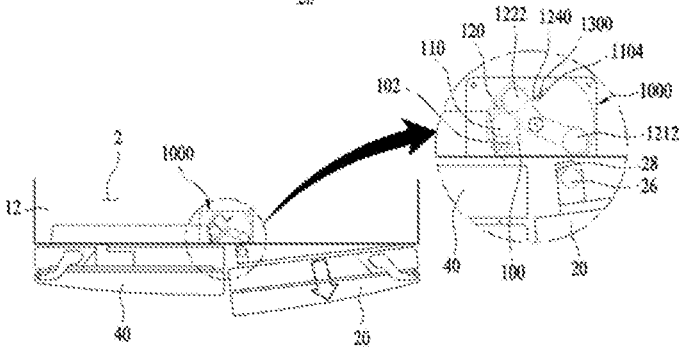

FIGS. 5A to 5C are views for explaining the state in which the first door is being opened when the second door is in the closed state.

Referring to FIGS. 5A to 5C, in the state in which the first door 20 and the second door 40 seal the storage compartment 2, a user may open the first door 20 while leaving the second door 40 as it is.

As shown in FIG. 5A, in the state in which the first door 20 and the second door 40 are closed by a user, the pillar 100 is in the unfolded state, and is in contact with the first door 20 and the second door 40 so as to seal the storage compartment 2. FIG. 5A shows the state in which the lifting guide unit 1400 is lowered and is caught by the pillar protrusion 130. However, a concrete illustration and explanation thereof will be omitted.

As shown in FIG. 5B, as the first door 20 is rotated, the distance between the first magnetic member 1212 and the first door magnetic member 26 is increased, and thus the rotary arm 1200 may be rotated in the clockwise direction. That is, as the repulsive force between the first magnetic member 1212 and the first door magnetic member 26 is reduced, the first door magnetic member 26 cannot sufficiently repel the first magnetic member 1212, and thus the rotary arm 1200 may be rotated in the clockwise direction by the restoring force of the elastic member 1300. The clockwise rotation of the rotary arm 1200 may be stopped at a position where the restoring force of the elastic member 1300 and the repulsive force between the first magnetic member 1212 and the first door magnetic member 26 are in equilibrium.

At this time, as the distance between the second door magnetic member 28 and the second pillar magnetic member 120 is decreased, magnetic interference may occur between the second door magnetic member 28 and the second pillar magnetic member 120 due to the repulsive force therebetween. Therefore, the pillar 100 may start to be rotated in the counterclockwise direction by the magnetic interference between the second door magnetic member 28 and the second pillar magnetic member 120.

As shown in FIG. 5C, when the first door 20 is rotated to a specific position, the first door magnetic member 26 and the first magnetic member 1212 are not substantially influenced by the repulsive force, and the elastic member 1300 may therefore be restored to the original shape thereof.

Because magnetic interference due to the repulsive force is not present between the second magnetic member 1222 and the first pillar magnetic member 110, the pillar 100 may be sufficiently folded. Further, because the pillar-fixing unit 50 applies force in the direction in which the pillar 100 is folded, the pillar 100 may be more easily rotated in the counterclockwise direction so as to be folded.

When only the first door 20 is in the opened state, the pillar 100 is in the folded state. Therefore, when a user pulls the drawer located near the first door 20 outwards, the drawer does not interfere with the pillar 100. Accordingly, even when the drawer located near the first door 20 and the drawer located near the second door 40 have the same width, withdrawal of the drawer by the user is not interrupted. That is, when the drawer is drawn outwards in the state in which only the door not having the pillar is opened, the pillar does not block the path along which the drawer moves outwards.

In addition, when only the first door 20 is rotated in the state in which the second door 40 is closed, the pillar 100 is changed to the folded state, and thus the length of the path along which the basket installed to the rear side of the first door 20 moves may be increased. This is because the pillar 100 is folded so as not to interfere with a structure installed on the first door 20, thereby increasing the moving path of the structure.

Figure 6A:
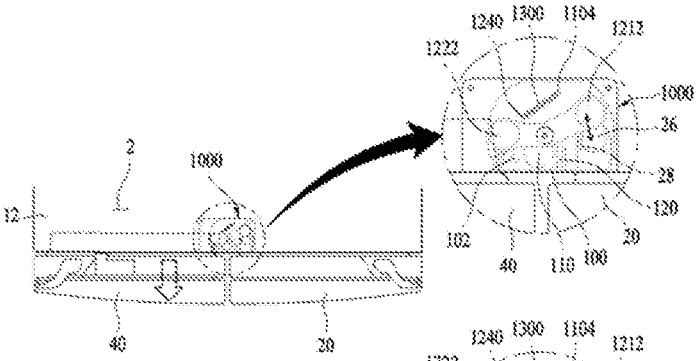
FIGS. 6A to 6C are views for explaining the state in which the second door is being opened when the first door is in the closed state.
Figure 6B:
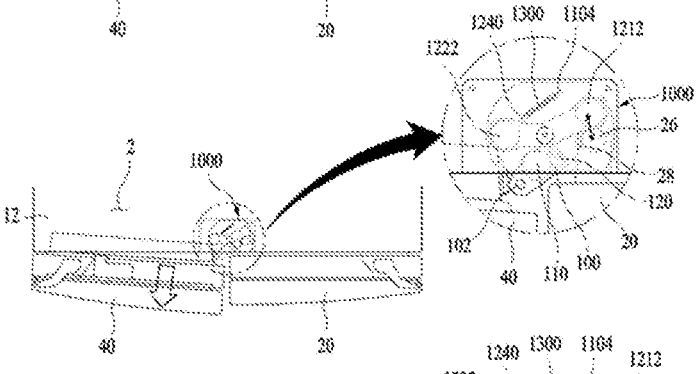
Figure 6C:
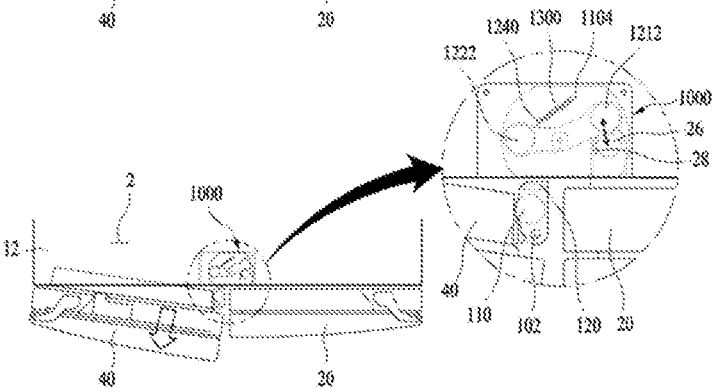

FIGS. 6A to 6C are views for explaining the state in which the second door is being opened when the first door is in the closed state.

Referring to FIGS. 6A to 6C, the second door 40 may be rotated in the state in which the first door 20 is closed.

At this time, in order to allow the second door 40 to be rotated and opened, the rotation of the second door 40 should not be interrupted by interference between the pillar 100 and the first door 20.

In this embodiment, the pillar 100 may be rotated by interference with the first door 20. Therefore, when the second door 40 is rotated in the state in which the first door 20 remains stationary, the pillar 100 may collide with the first door 20 and may be folded thereby.

Therefore, a user may open the second door 40 without being impeded by the first door 20.

In the state of FIG. 6A, because the pillar protrusion 130 is caught by the lifting guide unit 1400, while the second door 40 is rotated together with the pillar 100, the pillar 100 may be folded by being rotated relative to the second door 40.

Subsequently, in the states of FIGS. 6B and 6C, because the pillar 100 moves away from the lifting guide unit 1400, the lifting guide unit 1400 is changed to the raised state. A description related thereto will be made later with reference to FIGS. 8 to 10C.

Figure 7A:
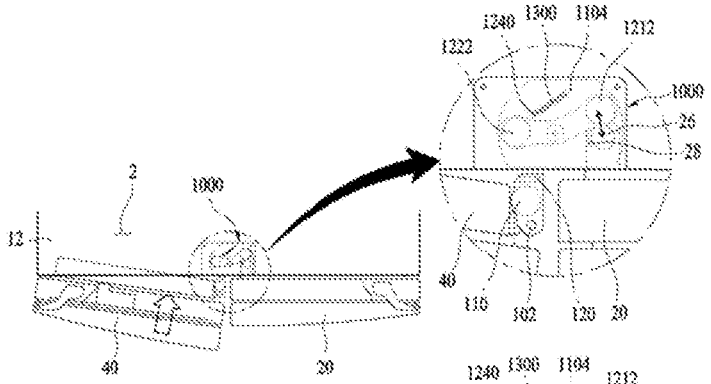
FIGS. 7A to 7C are views for explaining the state in which the second door is being closed when the first door is in the closed state.
Figure 7B:
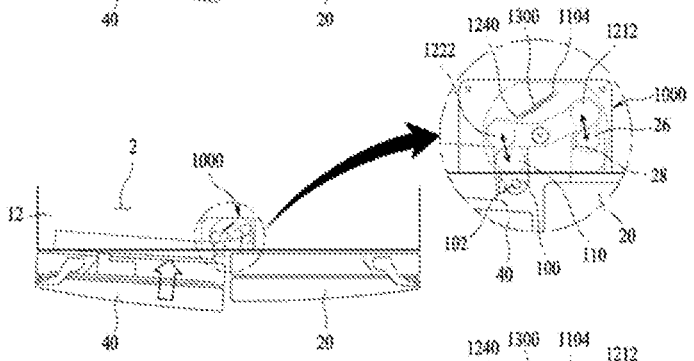
Figure 7C:
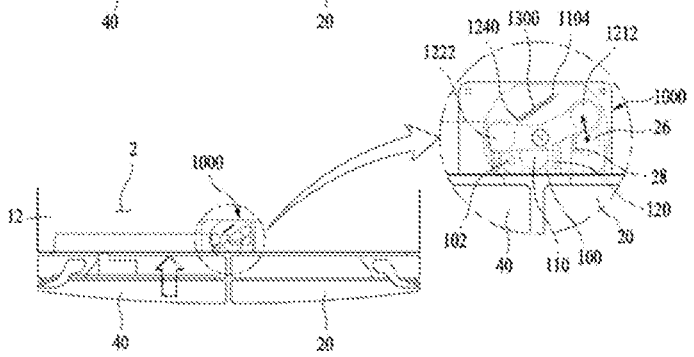

FIGS. 7A to 7C are views for explaining the state in which the second door is being closed when the first door is in the closed state.

Referring to FIGS. 7A to 7C, the second door 40 may be rotated in the state in which the first door 20 closes the storage compartment 2. At this time, the pillar 100 is maintained in the folded state. As shown in FIGS. 6A to 6C, when the second door 40 is opened, the pillar 100 is changed to the folded state. Furthermore, the pillar-fixing unit 50 applies force so that the pillar 100 remains folded. Therefore, the pillar 100 is in the folded state when the second door 40 is in the opened state.

Therefore, when the second door 40 is rotated so as to seal the storage compartment 2 in the state in which the first door 20 seals the storage compartment 2, the second door 40 may be rotated without interference between the pillar 100 and the first door 20.

That is, as shown in FIG. 7B, while the second door 40 is rotated, the pillar 100 is in the folded state, and thus is not caught by the first door 20.

As the second door 40 is rotated so as to seal the storage compartment 2, magnetic interference occurs between the second magnetic member 1222 and the first pillar magnetic member 110. At this time, a magnetic repulsive force is generated between the second magnetic member 1222 and the first pillar magnetic member 110, and the pillar 100 may be rotated by the second magnetic member 1222 at a certain time.

Because the repulsive force generated between the first magnetic member 1212 and the first door magnetic member 26 substantially makes the rotary arm 1200 stationary, the rotary arm 1200 is not rotated, and thus the position of the second magnetic member 1222 is not changed. As the second door 40 is rotated, the position of the first pillar magnetic member 110 may be changed, and thus the pillar 100 may be rotated in the clockwise direction.

As shown in FIG. 7C, when the second door 40 is rotated so as to seal the storage compartment 2, the pillar 100 may be rotated so as to come into contact with the first door 20 and the second door 40 while overcoming the force of the pillar-fixing unit 50 due to the repulsive force generated between the second magnetic member 1222 and the first pillar magnetic member 110. In the state of FIG. 7C, unlike the states of FIGS. 7A and 7B, the lifting guide unit 1400 may be lowered, and the pillar protrusion 130 may come into contact with the lifting guide unit 1400.

FIG. 8 is a cross-sectional view illustrating the operation of the lifting guide unit.

Referring to FIG. 8, the lifting guide unit 1400 is provided with a steel plate member 1420, which magnetically interferes with the first pillar magnetic member 110. If a magnet approaches the steel plate member 1420, the steel plate member 1420 may be moved toward the magnet by an attractive force.

The lifting guide unit 1400 includes a case 1410, which envelops the steel plate member 1420, and an elastic member 1430, which elastically supports the case 1410 in the upward direction. One end of the elastic member 1430 is secured to the inside of the transmission unit 1000, and the opposite end thereof is secured to the case 1410, thereby guiding the vertical movement of the case 1410 relative to the transmission unit 1000. The transmission unit 1000 has therein a space in which the case 1410 can move vertically.

The steel plate member 1420 may be disposed in the lower side of the case 1410 so as to be located close to the first pillar magnetic member 110.

When the first pillar magnetic member 110 moves close to the transmission unit 1000, i.e. the lifting guide unit 1400, magnetic interference between the first pillar magnetic member 110 and the steel plate member 1420 may be increased, the elastic member 1430 may be extended, and thus the case 1410 may be lowered. Conversely, when the first pillar magnetic member 110 moves away from the transmission unit 1000, i.e. the lifting guide unit 1400, magnetic interference between the first pillar magnetic member 110 and the steel plate member 1420 may be decreased, the elastic member 1430 may be restored to the original size thereof, and thus the case 1410 may be raised. When the elastic member 1430 has been restored to the original size thereof, the case 1410 is completely embedded in the transmission unit 1000. Thus, a user may not recognize the presence of the lifting guide unit 1400. Further, a user may use the storage compartment 2 without being impeded by the lifting guide unit 1400.

Figure 9A:
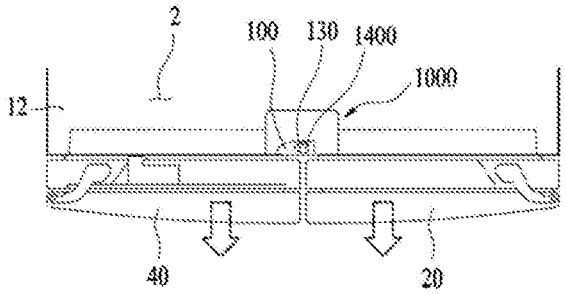
FIGS. 9A to 9C are views for explaining the state in which the first door and the second door are both being opened at the same time.
Figure 9B:
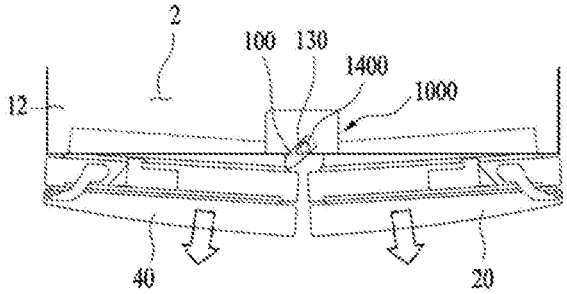
Figure 9C:
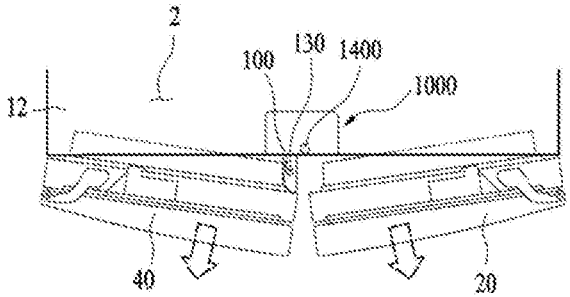
Figure 10A:
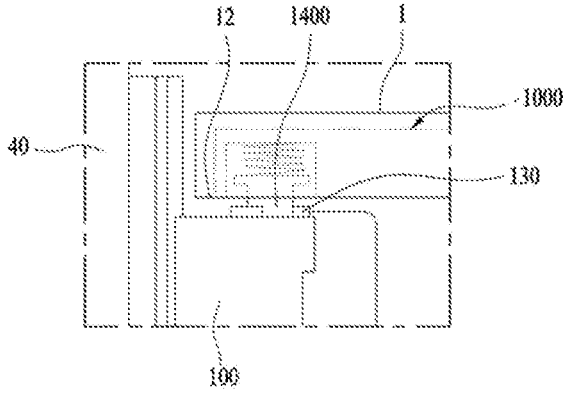
FIGS. 10A to 10C are side views of FIGS. 9A to 9C.
Figure 10B:
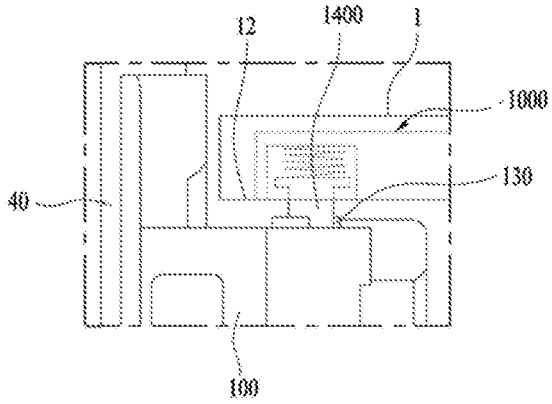
Figure 10C:
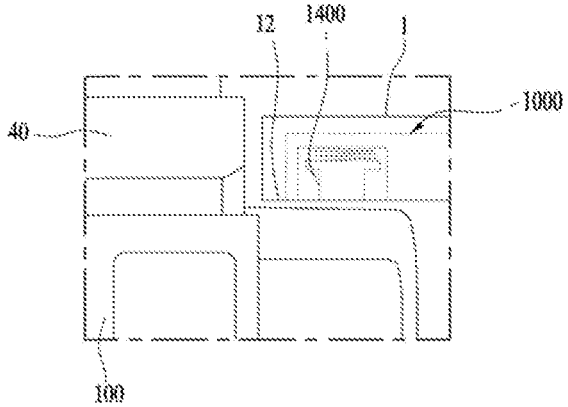

FIGS. 9A to 9C are views for explaining the state in which the first door and the second door are both being opened at the same time, and FIGS. 10A to 10C are side views of FIGS. 9A to 9C. In FIGS. 9A to 10C, the lifting guide unit is mainly illustrated, and the remaining elements of the transmission unit are omitted.

FIG. 10A is a side view illustrating the state of FIG. 9A, FIG. 10B is a side view illustrating the state of FIG. 9B, and FIG. 10C is a side view illustrating the state of FIG. 9C.

Referring to FIGS. 9A and 10A, the first door 20 and the second door 40 close the storage compartment 2 so as to seal the storage compartment 2.

The pillar 100 is in contact with the first door 20 and the second door 40, and is in the unfolded state so as to seal the storage compartment 2.

Accordingly, the lifting guide unit 1400 is located close to the first pillar magnetic member 110, and thus the lifting guide unit 1400 is lowered. At this time, because the pillar protrusion 130 is disposed on the rear surface of the lifting guide unit 1400 (the right surface on the basis of FIG. 10A), the pillar protrusion 130 may guide the rotating direction of the lifting guide unit 1400.

When a user rotates both the first door 20 and the second door 40 at the same time, the rotary arm 1200 may remain stationary without rotating. This is because, when the first door 20 and the second door 40 are rotated at the same time, variation in the magnetic force occurs on both the left side and the right side of the rotary arm 1200, and thus the rotary arm 1200 may not be rotated, depending on the circumstances.

In this case, referring to FIGS. 9B and 10B, the rear side of the lifting guide unit 1400 is in contact with the pillar protrusion 130. When the second door 40 is rotated, the pillar 100, i.e. the pillar protrusion 130, is movable, whereas the lifting guide unit 1400 is in a stationary state. Thus, the pillar protrusion 130 cannot pass through the lifting guide unit 1400, but is folded. That is, the pillar protrusion 130 is moved along the circumference of the lifting guide unit 1400, and the pillar 100 is therefore rotated in the direction in which the pillar 100 is folded by the pillar protrusion 130 and the lifting guide unit 1400.

Referring to FIGS. 9C and 10C, the pillar 100 is also folded when the first door 20 and the second door 40 are rotated at the same time.

As shown in FIG. 10C, when the second door 40 is sufficiently opened, the pillar 100 moves away from the transmission unit 1000. Therefore, the intensity of the magnetic force that is exerted on the lifting guide unit 1400 by the pillar 100 is reduced, and thus the lifting guide unit 1400 is raised. Because the lifting guide unit 1400 is completely inserted into the transmission unit 1000, a user may not recognize the presence of the lifting guide unit 1400, and may use the storage compartment without being impeded by the lifting guide unit 1400.

In general, when a user puts food into or takes the same out of the storage compartment, the storage compartment is in the state of being sufficiently opened by the door, and thus the lifting guide unit 1400 is in the state of being inserted into the transmission unit 1000. Therefore, a user may conveniently use the storage compartment without being influenced by the lifting guide unit 1400.

The present invention is not limited to the above-described exemplary embodiments, and, as is apparent from the appended claims, the present invention may be modified by those skilled in the art to which the present invention pertains, and such modification falls within the spirit and scope of the present invention.

The invention claimed is:

1. A refrigerator comprising:

a cabinet;

an inner case that is located inside of the cabinet and that defines a storage compartment;

a first door rotatably coupled to the cabinet and configured to open and close a first side of the storage compartment;

a second door rotatably coupled to the cabinet and configured to open and close a second side of the storage compartment, the second door comprising a pillar that includes a first pillar magnetic member disposed at an upper side of the pillar, that is configured to rotate between a folded state and an unfolded state relative to the second door, and that is configured to contact the first door based on the first and second doors being closed and the pillar being oriented in the unfolded state; and a transmission unit that is located in the inner case and that is configured to guide rotation of the pillar based on rotation of the second door, wherein the pillar is spaced apart from a top wall of the inner case and a bottom wall of the inner case without contacting the inner case in a state in which the second door closes the second side of the storage compartment, wherein the transmission unit comprises a lifting guide unit that includes a steel plate member configured to magnetically interfere with the first pillar magnetic member, that is configured to move down toward the pillar by magnetic force applied between the steel plate member and the first pillar magnetic member based on the second door being closed, and that is configured to contact the pillar based on rotation of the pillar from the folded state to the unfolded state, and wherein the pillar comprises a pillar protrusion that protrudes from the upper side of the pillar toward the top wall of the inner case, that is spaced apart from the top wall of the inner case, and that is configured to contact the lifting guide unit to thereby guide rotation of the pillar from the unfolded state to the folded state.

2. The refrigerator according to claim 1, wherein the pillar protrusion is configured to be positioned on a rear side of the lifting guide unit based on the lifting guide unit having moved down toward the pillar.

3. The refrigerator according to claim 1, wherein the lifting guide unit comprises:

a guide case that accommodates the steel plate member; and an elastic member that is configured to support the guide case upward in a direction away from the pillar.

4. The refrigerator according to claim 3, wherein the elastic member is configured to, based on the pillar approaching the lifting guide unit, extend toward the pillar to move the guide case down toward the pillar.

5. The refrigerator according to claim 1, wherein the transmission unit further comprises a rotary arm that is configured to rotate relative to the inner case based on rotation of the first door relative to the cabinet.

6. The refrigerator according to claim 5, wherein the rotary arm includes a first magnetic member at a first end of the rotary arm and a second magnetic member at a second end of the rotary arm, the second end being opposite to the first end.

7. The refrigerator according to claim 6, wherein the rotary arm is configured to rotate about a rotation center located between the first magnetic member and the second magnetic member.

8. The refrigerator according to claim 6, wherein the first door includes:

a first door magnetic member that is located at an upper side of the first door and that is configured to magnetically interfere with the first magnetic member; and a second door magnetic member that is located at a lateral surface of the first door, and wherein the pillar includes a second pillar magnetic member that is located at a lateral surface of the pillar and that is configured to magnetically interfere with the second door magnetic member.

9. The refrigerator according to claim 1, wherein the pillar is configured to rotate relative to the second door in a state in which the first door opens the first side of the storage compartment and the second door closes the second side of the storage compartment.

10. The refrigerator according to claim 1, wherein the pillar is configured to contact the first door and the second door in a state in which the first door and the second door close the first side of the storage compartment and the second side of the storage compartment, respectively.

11. The refrigerator according to claim 10, wherein the pillar is configured to, based on rotation from the folded state to the unfolded state, cover a space of the storage compartment between the first door and the second door.

12. The refrigerator according to claim 1, further comprising:

a first drawer located in the storage compartment at a first position that is closer to the first door than to the second door; and a second drawer located in the storage compartment at a second position that is closer to the second door than to the first door, wherein a width of the first drawer is equal to a width of the second drawer.

13. The refrigerator according to claim 12, wherein the first drawer and the second drawer are disposed in a same horizontal plane in the storage compartment, and wherein the first drawer and the second drawer are configured to independently withdraw outward from the storage compartment.

14. The refrigerator according to claim 13, wherein the pillar is configured to allow, based on rotation from the unfolded state to the folded state, allow withdrawal of the first drawer from the storage compartment in a state in which the second door closes the second side of the storage compartment.

15. The refrigerator according to claim 1, wherein a width of the first door is equal to a width of the second door.

16. The refrigerator according to claim 1, wherein the first side of the storage compartment and the second side of the storage compartment are arranged side by side.

17. The refrigerator according to claim 1, wherein the lifting guide unit is further configured to, based on the pillar moving away from the lifting guide unit, move upward from the pillar to be spaced apart from the pillar.

18. The refrigerator according to claim 1, wherein the lifting guide unit is further configured to, based on the pillar moving away from the lifting guide unit, insert into the transmission unit.

* * * * *